United States Patent [19]

Becker Friedbert et al.

[11] 4,296,400

[45] Oct. 20, 1981

[54] INSTALLATION FOR CONTROL OF A TRAFFIC LIGHT SYSTEM BY VEHICLES HAVING AN AUTOMATIC LOCATION DETERMINATION

[75] Inventors: Becker Friedbert; Johann Steinkamp, both of Munich; Klaus Koenen, Berg, all of Fed. Rep. of Germany

[73] Assignee: Siemens Aktiengesellschaft, Berlin & Munich, Fed. Rep. of Germany

[21] Appl. No.: 964,431

[22] Filed: Nov. 28, 1978

[51] Int. Cl.[3] ..... G08G 1/07

[52] U.S. Cl. ..... 340/32; 340/23; 455/93; 455/99

[58] Field of Search ..... 340/32, 33, 34, 23, 340/24; 325/117, 6, 111, 16, 21, 312, 314, 103; 364/460, 436, 424; 455/95, 99, 11, 25, 89, 78, 93, 152, 345

[56] References Cited

U.S. PATENT DOCUMENTS

| | | | |
|---|---|---|---|
| 3,828,307 | 8/1974 | Hungerford | 340/23 |
| 4,016,532 | 4/1977 | Rose | 340/32 |
| 4,017,825 | 4/1977 | Pichey | 340/32 |
| 4,083,003 | 4/1978 | Haemmig | 340/23 |

*Primary Examiner*—James J. Groody

*Attorney, Agent, or Firm*—Hill, Van Santen, Steadman, Chiara & Simpson

[57] ABSTRACT

An installation for the control of a traffic light system by means of vehicles which are equipped with devices for automatic determination of position, i.e. bearing determination, and which includes therefore a first, transmission/reception antenna having a transmission direction perpendicular to the direction of travel for the transmission of bearing information, and a second antenna, arranged to transmit in the direction of travel, for the transmission of transfer messages or commands for control of lights of such a traffic light system. Means are also provided for selectively determining the type of signals to be transmitted and the corresponding antenna for such transmission.

2 Claims, 2 Drawing Figures

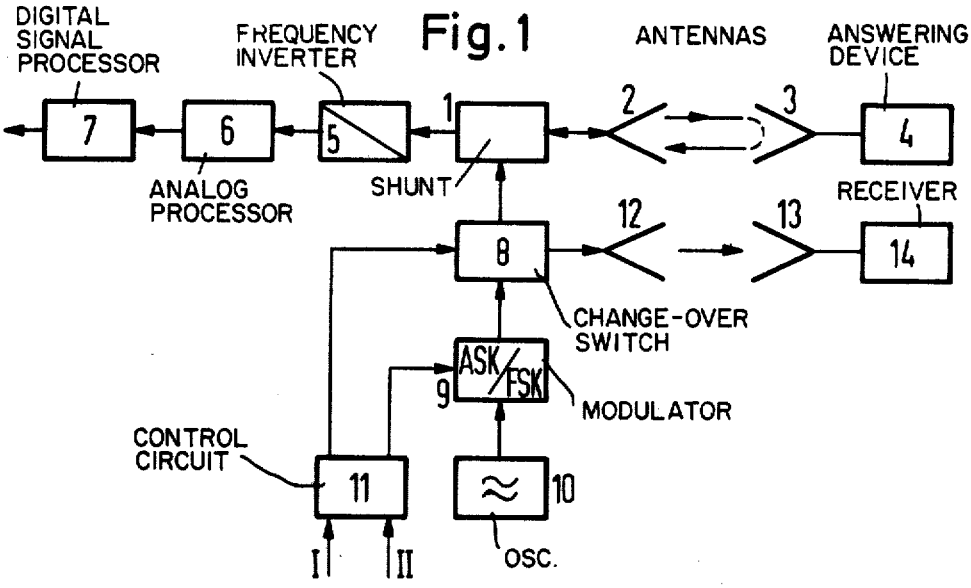
Fig. 1
Fig. 2
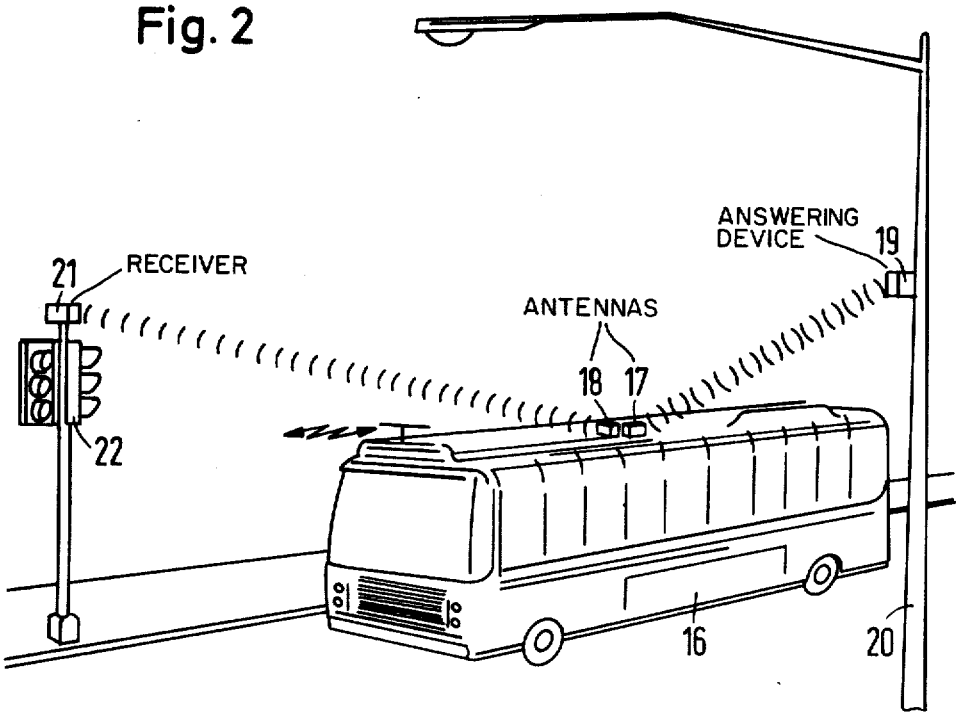

INSTALLATION FOR CONTROL OF A TRAFFIC LIGHT SYSTEM BY VEHICLES HAVING AN AUTOMATIC LOCATION DETERMINATION

BACKGROUND OF THE INVENTION

The invention is directed to an installation for the control of a traffic light system by vehicles which are provided with devices for automatic determination of position or bearing.

It is obvious that with the constant increase in motorized transportation, and thus the increase of inner city traffic, public vehicles of local transit systems, such as buses and street cars, must provide their services in congested areas under constantly increasingly difficult conditions. However, it is precisely these forms of transportion that should be attractive to the user and efficient in their operation. This, in turn, involves the requirements of high speed, dense car succession and maintenance of schedules. An effective disposition of public local transportation facilities, therefore, dictates the possibility for enforced control of the green phases of traffic signals. Such an enforced control, however, is even more urgent in connection with the operation of emergency and police vehicles.

In street cars, such a request for the green phase can be triggered by means of track or trolley contacts. Where buses are involved, inductive loops usually are employed a few hundred meters ahead of the intersection. Either the presence only of a bus is determined by means of a loop, or the length of a bus may be measured by means of two loops. However, either arrangement can lead to erroneous report, for example, where trucks of a similar size are involved. While this disadvantage can be avoided by the utilization of a transmitter on the bus, there still remains the rather expensive installation of a recording cable from the loop to the traffic light.

In other systems, this disadvantage is avoided in that the request is emitted directly from the vehicle to a traffic light receiver over the atmosphere, for example, by means of radio, ultrasonics, or infrared radiation.

BRIEF SUMMARY OF THE INVENTION

It is the object of the invention to provide a simple solution, in an installation for the control of a traffic light system in which such vehicles are provided with devices for automatic position or bearing determination.

In such a locating system, or in such a position determination of vehicles whose path is involved, two criteria are compared from the standpoint of practicality. First, the rigidly fixed distance between a starting point and the passage of a location indicator, and second, the segment of the path or route traversed from the starting point up to such location indicator, as indicated by the odometer of the vehicle. As the exact distance between the starting point and that of the location indicator involved, is known in the central headquarters of the system a computer, for example, can determine the deviation between the actual value and that transmitted from the trip odometer reading, and correct all subsequent data for such vehicle by means of a correction factor. In this manner, a high precision can be achieved in the determination of location.

In such a transmission system involving information transmission between a respective location indicator and the vehicle, a sensing device is provided in the vehicle and an answering device, i.e. the location indicator, are provided and suitably mounted at specific intervals along the path or route.

The objective of controlling traffic light systems by means of vehicles equipped with locating systems of the type above described in achieved, in accordance with the invention, by the use of an antenna on the vehicle whose transmission direction is oriented with the direction of travel. Such antenna is provided in addition to the transmission/receiving antenna utilized in the position or location determination, which has a transmission direction disposed perpendicularly to the direction of travel. The vehicle is provided with means for producing transfer messages or commands which can be supplied over said additional antenna to a receiver installation at the traffic light.

In an advantageous embodiment of the subject matter of the application, an antenna change-over switch is provided whose input can be selectively connected to the antenna for the traffic light control, and over a shunt to the pertinent portion of the locating system, such switch being so controlled by a suitable circuit that, in correspondence to the information appearing for transmission at its input, in the form of modulation signals, i.e. information for the location or bearing, or request or transfer messages or commands, is operatively supplied to the appropriate output.

Advantageously, the request or transfer messages or commands are modulated upon a carrier in a modulation process that is orthogonal to that of the locating system.

In a further advantageous development of the invention, additional location-selective information may be transmitted to additional receivers installed along the route or path, by means of which, for example, arrival information and the like can be transmitted and supplied to an arrival display at a bus stop or station.

BRIEF DESCRIPTION OF THE DRAWINGS

In the drawings, wherein like reference characters indicate like or corresponding parts:

FIG. 1 is a block diagram illustrating a locating system having a traffic light control combined therewith; and FIG. 2 is a perspective view of a bus, in street traffic illustrating the required locating and light controlling installations on the bus and cooperable street installations.

DETAILED DESCRIPTION OF THE INVENTION

Referring to the block diagram of FIG. 1, the elements of the locating system are disposed in the upper row. Thus, a shunt 1 is provided, at one side of which the transmission/receiving antenna 2 is connected, and which is adapted to be aligned with the antenna 3 of the answering device or location indicator 4. Connected to the shunt 1 at the other side thereof is a frequency inverter 5 to which is connected a unit 6 for analog processing which in turn is connected to the input of a unit 7 for digital signal processing. The data output appears at the digital signal processor 7.

Such locating system is supplemented by an installation for traffic light control, and comprises an antenna change-over switch 8, having one output connected with the shunt 1, and a second output which is connected to an additional transmission antenna 12 for traffic light control operations. The antenna 12 is aligned with the antenna 13 at the traffic light receiver 14. One input of the antenna change-over switch 8 is connected with a modulator 9 to which a fixed frequency oscillator 10, having a frequency f=2.45 GHz, is connected. The modulator 9 is of a type adapted to selectively supply either of two types of modulation, either of which may be selected by a control circuit 11 having its two outputs respectively connected to the antenna change-over switch 8 and the modulator 9. The switch 8 is adapted to supply signals from the modulator 9 either to the shunt 1 and the antenna 2, for transmission to the antenna 3 and answering device 4 of the locating system, or to the antenna 12, for transmission to the antenna 13 and receiver 14 of the traffic light control system.

The locating system thus is so expanded that request or transfer messages or commands can be additionally modulated and supplied to the responsive equipment in a suitable manner. Consequently, a modulation can be employed for the traffic light control operations which is orthogonal to that employed in the locating system, whereby an optimum interference decoupling of both functions is achieved, even in the case of a simultaneous employment of numerous vehicles. Thus, for example, when the locating function is effected by means of ASK (amplitude shift keying), then FSK (frequency shift keying) is employed for the transmission for request for transfer messages or commands. The control or change-over of the modulator 9 from one type of modulation to the other, is determined by the control circuit 11 on information supplied to the input I thereof as to the desired type of transmission desired. The traffic light control message content is then supplied to the control circuit 11 over the input II.

As a result of the simultaneous control of the change-over switch 8 and the modulator 9 by the control circuit 11, either an ASK-signal (amplitude modulated non-linear signal) is supplied over the shunt 1 to the locating installation, or an FSK-signal (frequency modulated signal) is supplied to the additional antenna 12 for transmission to the receiver 14 of the traffic light. It may be further provided that the individual segments of the path or route receive an identification signal, so that the incoming control message is, in each case, evaluated only by that traffic light for which it is intended.

While the antenna change-over switch 8 can under certain conditions be omitted, such switch advantageously functions for the further decoupling of the locating and light-control portions of the circuit.

FIG. 2 illustrates a bus 16 in street traffic, which is provided with a transmission/receiving antenna 17 mounted on the bus roof for the locating or traffic guidance system, and having a radiation direction perpendicular to the direction of travel. A further antenna 18 is also provided which is so disposed that its radiation direction extends in the direction of travel. The transmission/receiving antenna 17 is linked by radio with an answering device 19, i.e. a recognition emitter, which is mounted on a light pole 20 at the side of the street. On the other hand, the antenna 18 is adapted to transmit, by radio, control signals to the receiver 21 on the traffic light 22, by means of which the additional control of the traffic light system is effected.

Although we have described our invention by reference to particular illustrative embodiments, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim as our invention:

1. In an installation for the control of a traffic light system from a vehicle, the combination of means carried by the vehicle for supplying information for automatic determination of position, i.e. bearing determination, a first directional antenna for transmission/reception, carried by the vehicle for transmission of such bearing information and having its transmission direction oriented essentially perpendicular to the direction of travel of the vehicle, a second directional antenna carried by the vehicle and oriented in the direction of travel of the vehicle for transmission of transfer messages or commands for the control of lights of such a traffic light system, means for producing carrier waves, means for modulating said carrier waves, said means for modulating is adapted to provide two types of modulated signals which are orthogonal to one another, one for the modulation of bearing information and the other for the modulation of transfer messages or commands, change-over switch means selectively connecting said means for modulating to said first antenna over a shunt means or to said second antenna, and control means connected to said change-over switch means and said means for modulating for selectively controlling the type of modulation utilized and the antenna employed for a selected transmission.

2. In a vehicular location system with a first directional antenna for receiving or transmitting vehicular location related information connected to means for demodulating received vehicular location related messages and a second directional antenna for transmitting traffic light control messages connected to means for modulating a carrier signal with said traffic light control message, an improvement wherein:

said first directional antenna is oriented substantially perpendicular to the direction of vehicular travel and said second directional antenna is oriented substantially along the direction of vehicular travel; and said means for modulating has a control input port and is adapted to generate a modulated signal with a first or second type of modulation upon sensing a first electronic signal generated by a control means based on whether a vehicular location message or a traffic signal control message is to be transmitted; and means for connecting said generated modulated signal to either the first or the second antenna upon sensing a second electronic signal generated by said control means based on whether a vehicular location message or a traffic signal control message is to be transmitted; whereby said transmitted vehicular location related messages and said transmitted trafffic light control related messages are orthogonal to one another.

* * * * *